US007814854B2

(12) United States Patent
Jouffroy

(10) Patent No.: US 7,814,854 B2
(45) Date of Patent: Oct. 19, 2010

(54) REMOVABLE DEVICE WITH FOLDABLE FLOATS FOR TRANSFORMING A MONOHULL VESSEL INTO A MULTIHULL VESSEL AND VESSEL COMPRISING THE DEVICE

(76) Inventor: Frederic Jouffroy, 2, Allee Mont Vallier, Lotissement les Coteaux, F-31280 Aigrefeuille (FR)

( * ) Notice: Subject to any disclaimer, the term of this patent is extended or adjusted under 35 U.S.C. 154(b) by 0 days.

(21) Appl. No.: 11/909,625

(22) PCT Filed: Mar. 23, 2006

(86) PCT No.: PCT/EP2006/061006

§ 371 (c)(1),
(2), (4) Date: Jul. 7, 2008

(87) PCT Pub. No.: WO2006/100297

PCT Pub. Date: Sep. 28, 2006

(65) Prior Publication Data

US 2009/0007831 A1 Jan. 8, 2009

(30) Foreign Application Priority Data

Mar. 25, 2005 (FR) ..... 05 02975

(51) Int. Cl.
*B63B 1/00* (2006.01)

(52) U.S. Cl. ..... 114/61.18; 114/39.21; 114/282; 114/283

(58) Field of Classification Search ..... 114/39.21, 114/39.28, 39.32, 61.1, 61.15, 61.18, 123, 114/282, 283, 292, 354
See application file for complete search history.

(56) References Cited

U.S. PATENT DOCUMENTS

| | | | | |
|---|---|---|---|---|
| 655,234 | A * | 8/1900 | Howe et al. | 114/123 |
| 3,949,695 | A * | 4/1976 | Pless | 114/283 |
| 4,641,594 | A * | 2/1987 | Birkett | 114/43 |
| 4,898,113 | A * | 2/1990 | Tapley et al. | 114/283 |
| 6,024,041 | A * | 2/2000 | Eglais | 114/61.1 |
| 6,050,210 | A * | 4/2000 | Grzybowski | 114/123 |
| 6,305,306 | B1 * | 10/2001 | Grzybowski | 114/123 |

FOREIGN PATENT DOCUMENTS

| | | |
|---|---|---|
| DE | 2435005 | 2/1976 |
| FR | 2529855 | 1/1984 |
| FR | 2808251 | 11/2001 |
| GB | 1179881 | 2/1970 |

* cited by examiner

*Primary Examiner*—Lars A Olson
(74) *Attorney, Agent, or Firm*—Young & Thompson

(57) ABSTRACT

A device (1) for converting a monohull vessel (2) into a multihull vessel, includes a support structure (3) which is removably fixed to the vessel (2) and at least one lateral float (4) which is solidly articulated with the support structure (3) around at least one geometrical axis (BB'). The aforementioned float (4) can occupy (i) a first stable deployed position in which it is parallel to the vertical longitudinal geometric plane (PP') containing the keel line of the vessel (2) and, at the lowest point of the keel line thereof, it is disposed beneath the geometric axis (BB') and (ii) a second stable collapsed position which is separated at an angle from the first position. A vessel equipped with the device is also disclosed.

26 Claims, 12 Drawing Sheets

A
A'
D
D'
2
3
15
16
17
18
19
20
21
32
151
152
181
191
192
200
201
202

REMOVABLE DEVICE WITH FOLDABLE FLOATS FOR TRANSFORMING A MONOHULL VESSEL INTO A MULTIHULL VESSEL AND VESSEL COMPRISING THE DEVICE

TECHNICAL FIELD

This invention has as its object a removable device for transforming a monohull vessel such as a kayak, for example, into a multihull vessel such as a trimaran, for example. This invention also relates to a vessel that is equipped with a device according to the invention.

PRIOR ART

As a general rule, the vessels with a central hull and with lateral floats offer good qualities of speed and stability by the slimness of their hulls and the spacing of the floats, but under certain sea conditions, the multihull configuration may be a source of violent movements and may create a significant resistance to travel compared to a monohull vessel. This is due essentially to the aerodynamic drag of the holding structure of the floats and the hydrodynamic drag generated by the lateral floats.

Another drawback of certain multihull vessels essentially lies in the fact that they have a significant space requirement that makes their transport and their onshore parking difficult.

A trimaran with a variable width whose floats are mounted at one end of a horizontal beam that is attached to a turret that is mounted to rotate on the structure of the vessel is known from the application FR 2 808 251. In the folded position, the floats can be brought back against the hull, while in a position of use, they are moved away from it. An improved multihull boat whose hulls are connected by rigid connecting arms that are articulated and can be folded on one of the hulls so as to facilitate the transport is also known from FR 2 529 855.

DISCLOSURE OF THE INVENTION

Technical Problem

The two inventions, as indicated in the two patent applications that are cited above, provide a solution to the problem of transport of vessels with a small space requirement but do not allow a multihull vessel to be transformed into a monohull vessel.

Technical Solution

The primary object of the invention is therefore to be able to transform, during use, a monohull vessel into a multihull vessel and vice versa so as to be able in particular to adapt the vessel quickly to the current sea and wind conditions.

Another object of this invention is to propose a device with floats that is removable and that can be placed by the user in a folded configuration on the vessel and in a deployed configuration to transform the monohull vessel into a multihull vessel.

For this purpose, the device according to the invention, to transform a monohull vessel into a multihull vessel, is characterized essentially in that it comprises:

A support structure that is provided to be attached in a removable manner to the vessel, whereby this support structure has a geometric axis AA' which, when the structure is in a multihull configuration position, is horizontal or approximately horizontal, and when projected in the horizontal plane, has an angle of more than 30 degrees with a horizontal geometric axis that is secant to it and that is contained in the longitudinal vertical geometric plane PP' that contains the keel line of the vessel, And at least one lateral float that has a longitudinal axis FF' that is contained in the geometric plane that contains its keel line, whereby said float is made integral with this support structure in an articulated manner around at least one geometric axis BB' that is secant and oblique to the axis AA', and whereby said float can occupy a first deployed stable position along which, by its longitudinal geometric axis FF', it is parallel to the geometric plane PP' of the vessel, and, by the lowest point of its keel line, it is placed under the geometric axis BB', and a second folded stable position that is separated from the preceding position at an angle.

According to another characteristic of the invention, when projected in a horizontal geometric plane, the axis BB' is parallel or approximately parallel to the bisector of one or the other of the 180° complementary angles that are formed by the axis AA' and the axis FF' in the deployed position of the float.

According to another characteristic of the invention, according to the folded stable position of the float, the geometric axis FF' of the float is parallel or approximately parallel to the geometric axis AA'.

According to another characteristic of the invention, the float that is in folded stable position, by the lowest point of its keel line, is placed above the axis AA'.

The advantage of these arrangements lies in the fact that the device in the folded state occupies a relatively small space that allows its storage on the bridge of a monohull vessel.

The invention also relates to a vessel that is characterized essentially in that it is equipped with at least one device according to the invention.

Thus, this vessel can pass quickly from a monohull configuration to a multihull configuration and vice versa.

BRIEF DESCRIPTION OF THE DRAWINGS

Other purposes, advantages and characteristics of this invention will emerge from reading the description of a preferred embodiment that is provided by way of nonlimiting example, by referring to the accompanying drawings, in which.

BETTER EMBODIMENT OF THE INVENTION

Figure 1:
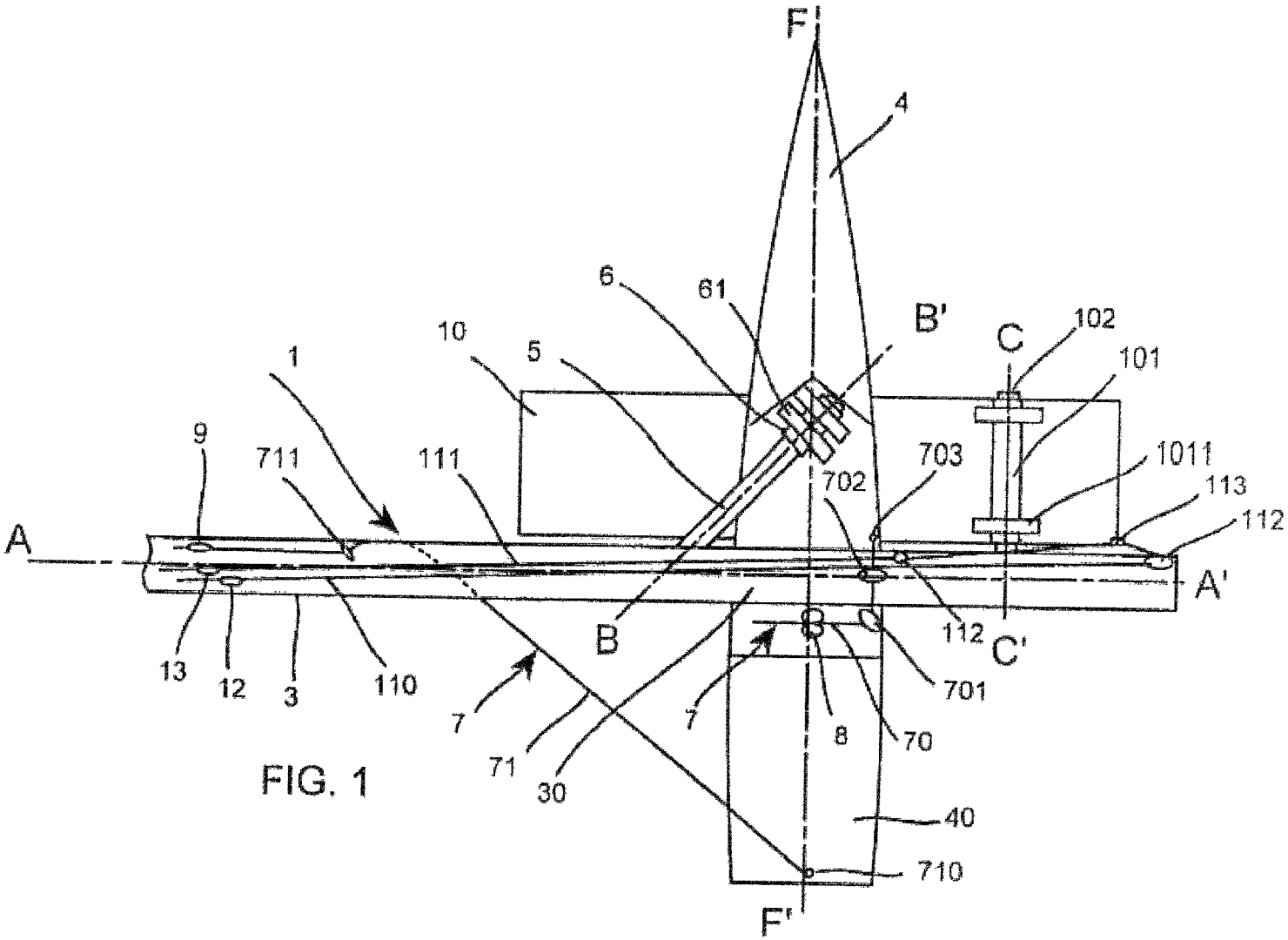
FIG. 1 is a top view of the device according to the invention in deployed configuration.
Figure 2:
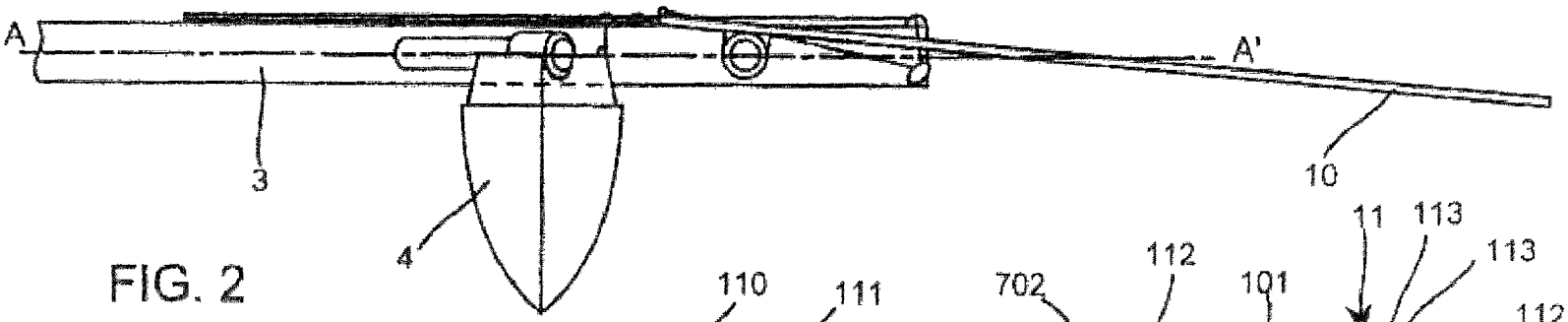
FIG. 2 is a front view of the device according to the invention in deployed configuration, foil raised.
Figure 3:
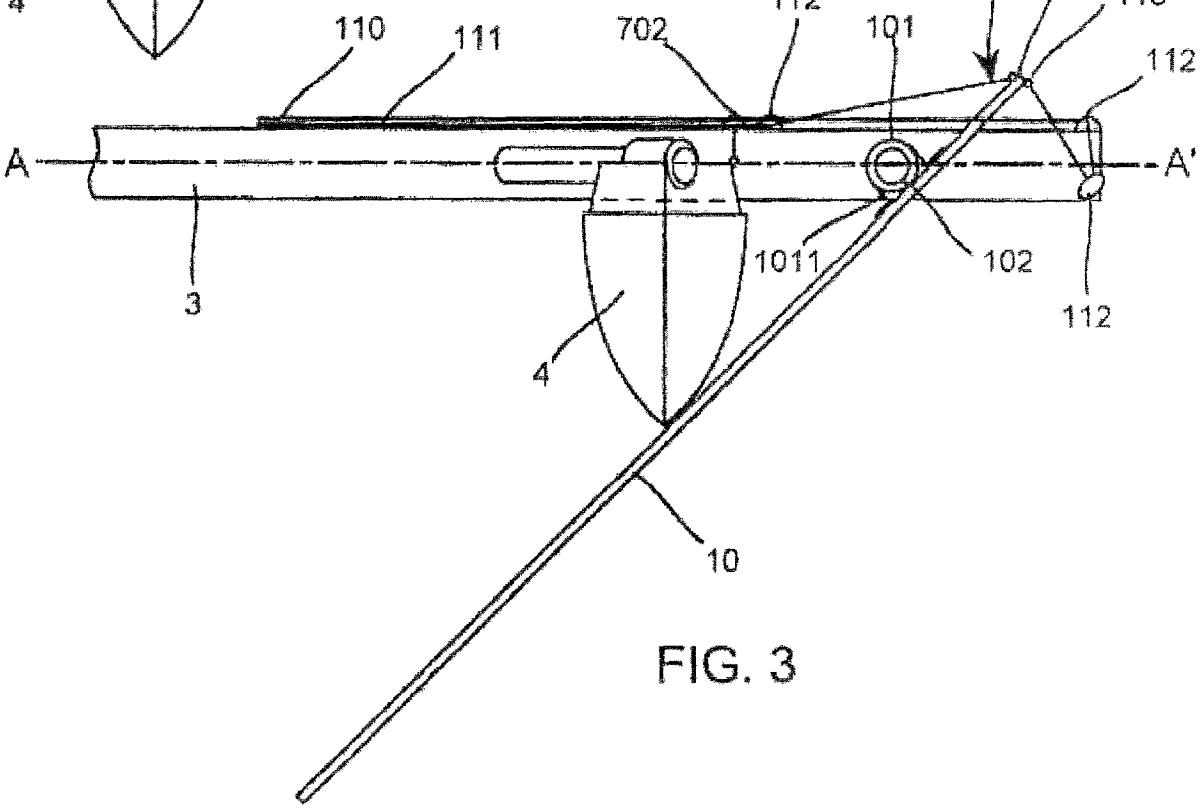
FIG. 3 is a front view of the device according to the invention in deployed configuration.
Figure 4:
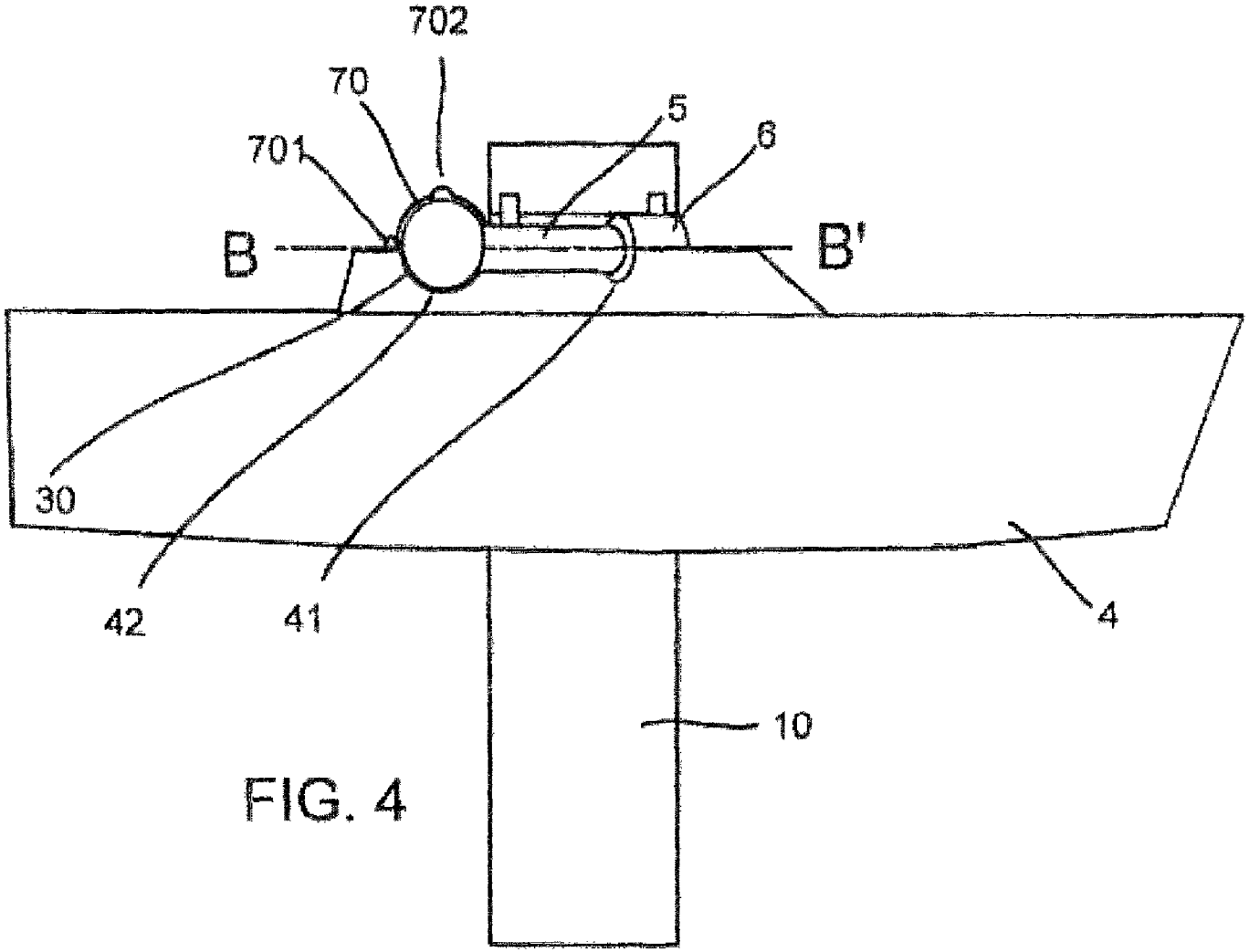
FIG. 4 is a lateral view of the device according to the invention in deployed configuration.
Figure 5:
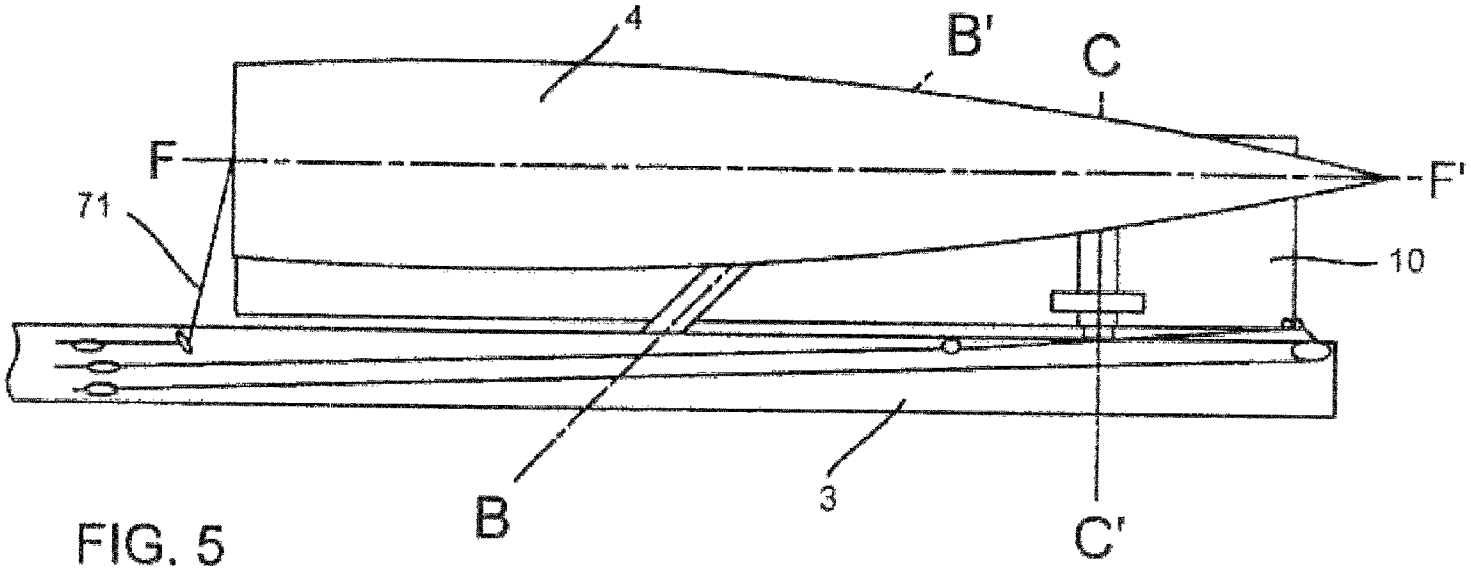
FIG. 5 is a top view of the device according to the invention in the folded configuration.
Figure 6:
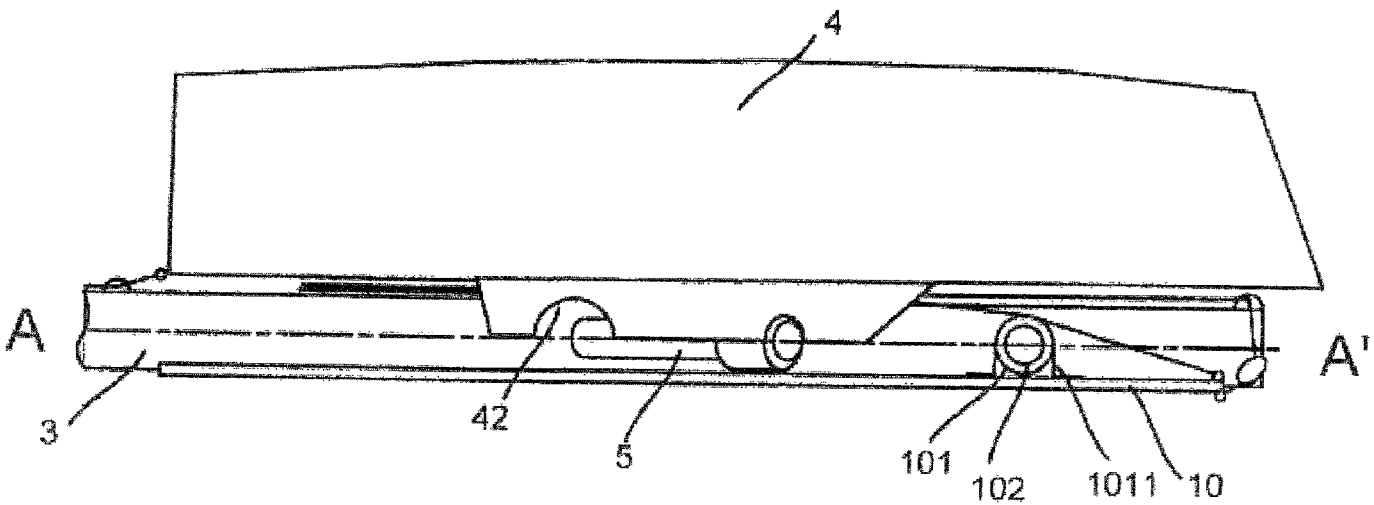
FIG. 6 is a front view of the device according to the invention in folded configuration.
Figure 7:
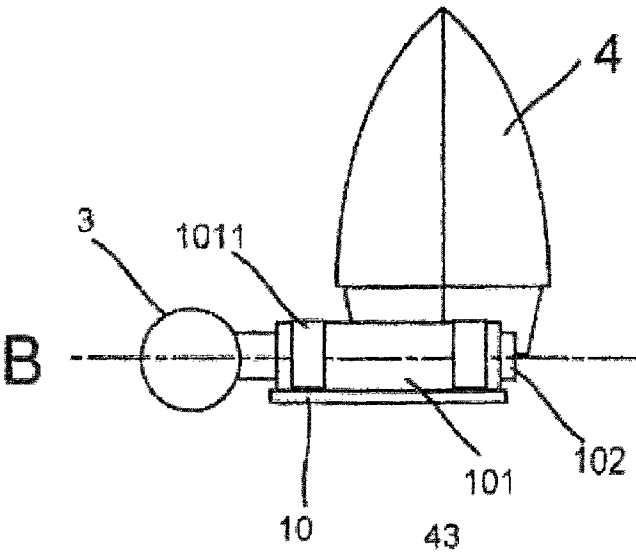
FIG. 7 is a lateral view of the device according to the invention in folded configuration.

As shown, the device 1 according to the invention, to transform a monohull vessel 2 into a multihull vessel, comprises in particular a support structure 3 and at least one lateral float 4 that is made of synthetic material or the like, preferably hollow, made integral with this support structure 3.

The support structure 3, designed to be fixed in a removable manner to the vessel 2, has a longitudinal geometric axis AA' which, when the structure 3 is in a multihull configuration position on the vessel 2, is horizontal or approximately horizontal and has, when projected in the horizontal plane, an angle of more than 30 degrees with a horizontal geometric axis that is secant to it and that is contained in the longitudinal vertical geometric plane PP' that contains the keel line of the vessel.

The float 4 has a longitudinal axis FF' that is contained in the longitudinal geometric plane that contains its keel line. This float is made integral with the support structure 3 in an articulated manner around at least one geometric axis BB' that is secant and oblique to the axis AA'.

This float 4 can occupy a first deployed stable position according to which it is parallel to the geometric plane PP' of the vessel 2 by its longitudinal geometric axis FF', and it is placed under the geometric axis BB' by the lowest point of its keel line. This float can occupy a second folded stable position that is separated from the above at an angle.

When projected into a horizontal geometric plane, the axis BB' is parallel or approximately parallel to the bisector of either of the two 180° complementary angles that are formed by the axis AA' and the axis FF' with the float in the deployed position.

According to the folded stable position, the geometric axis FF' of the float is parallel or approximately parallel to the geometric axis AA'.

According to this folded stable position, the lowest point of the keel line of the float 4 is located above the axis AA'.

Preferably, the geometric axes AA' and BB' define a horizontal or approximately horizontal geometric plane.

According to the preferred embodiment, in a multihull configuration position, the axis AA' is perpendicular to the geometric plane PP'. When projected into the horizontal plane, the geometric axis BB' and the geometric axis AA' form an angle that is equal or approximately equal to 45 degrees, and the geometric axis BB' and the geometric axis FF' in the deployed position of the float 4 form an angle that is equal or approximately equal to 45 degrees.

Starting from its intersection with the geometric axis AA', the geometric axis BB' is used preferably facing forward, viewed from the normal direction of travel of the vessel 2 or, as a variant, facing backward. It extends preferably outward, but, as a variant, it can extend inward.

When it is brought from a stable position to the other position, the float 4 pivots by an angle that is equal or approximately equal to 180 degrees around the geometric axis BB'. Thus, when it is folded, the upper face 40 of the float is rotated downward.

In the preferred embodiment, the support structure 3 consists of a preferably tubular longitudinal arm, made of carbon fiber, for example. With such a support structure configuration, the axis of the tubular arm and the geometric axis AA' are combined.

The support structure 3 is equipped with at least one cylindrical journal 5 that is mounted in such a way that it can rotate freely and is secured in translation in a guide bearing 6 that is formed on the float 4, whereby the median longitudinal axis of the cylindrical journal, the longitudinal median axis of the guide bearing, and the geometric axis BB' are combined.

In the preferred embodiment, the cylindrical journal 5, tubular in shape, is attached to the arm 3 via a casing shell 31 that is integral with the aim 3. This casing shell consists of two half-shells that are clamped and the arm 3 and the cylindrical journal 5, attached to one another by bonding along a diametric attachment plane to the arm 3 and to the journal 5. These two half-shells will be bonded to the arm 3.

According to the preferred embodiment, the two half-shells, as far as their parts around the journal are concerned, are not attached to one another by bonding but at this level form clamping jaws that can press on said journal to ensure the immobilization of the latter both in rotation and in translation. They are combined with a clamping means that applies them firmly against the journal 5. This clamping means can be released to reduce the pressure of the jaws on the journal and to allow the release of the latter. The clamping means advantageously consists of a removable clamping collar 311 of a known type that is engaged around jaws.

The guide bearing 6 is preferably supported by the upper face 40 of the float 4 and is formed by, for example, a bearing ring that is engaged in a semi-cylindrical hollow 41 that is made recessed in said upper face 40 and is secured in a circumferential arc in said hollow 41 by flange elements 61, attached at a distance from one another, in any known manner, for example by screws, to the upper face 40 of the float 4. Any other bearing element can be used.

The advantage of a bearing as described lies essentially in its simplicity and in its ease of upkeep.

Preferably, the journal 5 passes through the bearing ring 6 and receives two rings 62 that form a stop in a removable manner at the front and at the back of this bearing ring. These two rings have the purpose of immobilizing in translation the journal 5 in the bearing ring 6. These two rings can consist of clamping collars of a known type, of the detachable type. These arrangements facilitate the detachments and reattachments of the bearing 6.

In a deployed position, the float 4 is applied, preferably by its upper face 40, against a stop 30 that is integral with the support structure 3 or formed in the latter. This stop 30 actually forms the end-of-travel stop of the float 4 in the direction toward its deployed position.

The upper face 40 of the float 4 is provided with a housing 42 that is preferably in the form of a recessed hollow, designed to come around the stop 30 in the deployed position of the float 4. In the deployed position, the float 4 is therefore kept perfectly in position by the interlocking of shape produced between the fork that forms the journal 5 and the stop 30 and the two recessed hollows 41, 42 that are made in the upper face 40 of the float 4. Thus, the resistance of the connection between the float 4 and the structure 3 is greatly increased when said float 4 receives significant stresses that tend to impose on it twisting movements of rolling, pitching, pounding, yawing, cavorting or combinations of these movements.

Figure 8:
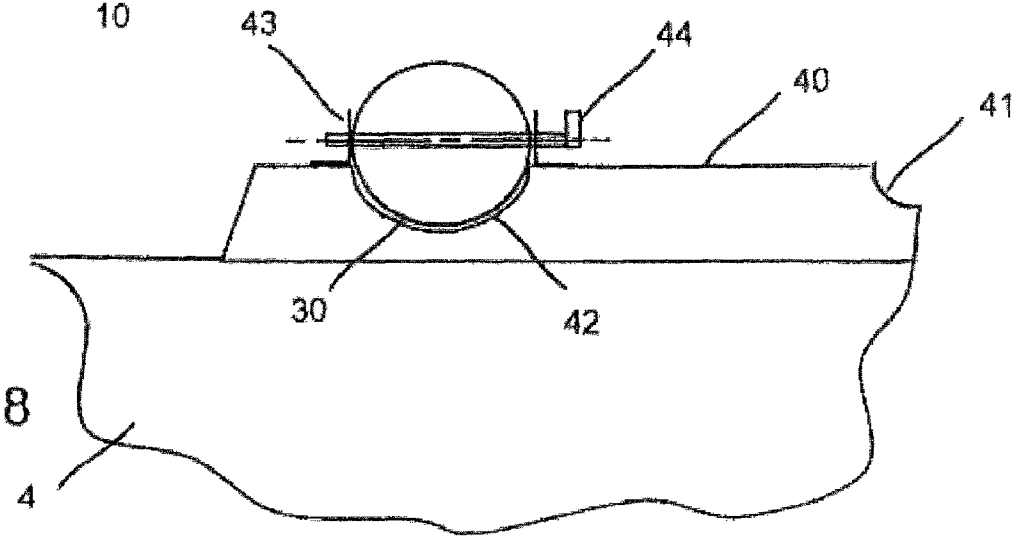
FIG. 8 is a detail view of the locking systems, which work by pinning the float in the deployed position, as well as the foil according to the invention.
Figure 9:
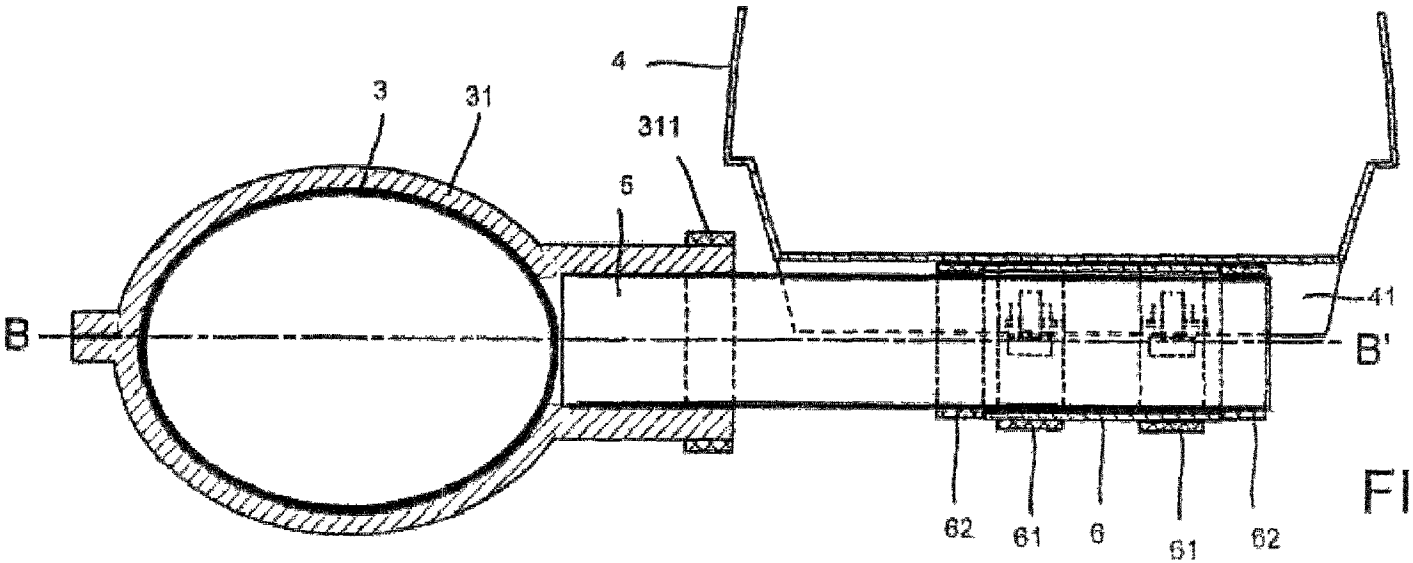
FIG. 9 is a detail cutaway view showing how the float is articulated to the support structure according to the invention.
Figure 10:
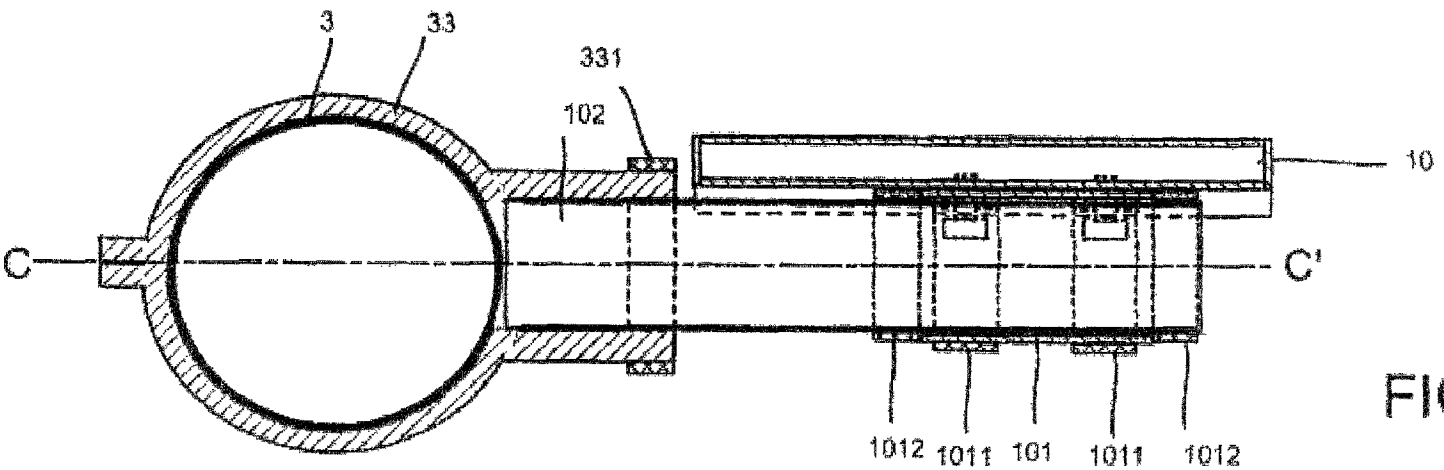
FIG. 10 is a detail cutaway view showing how the foil is articulated to the support structure.
Figure 11:
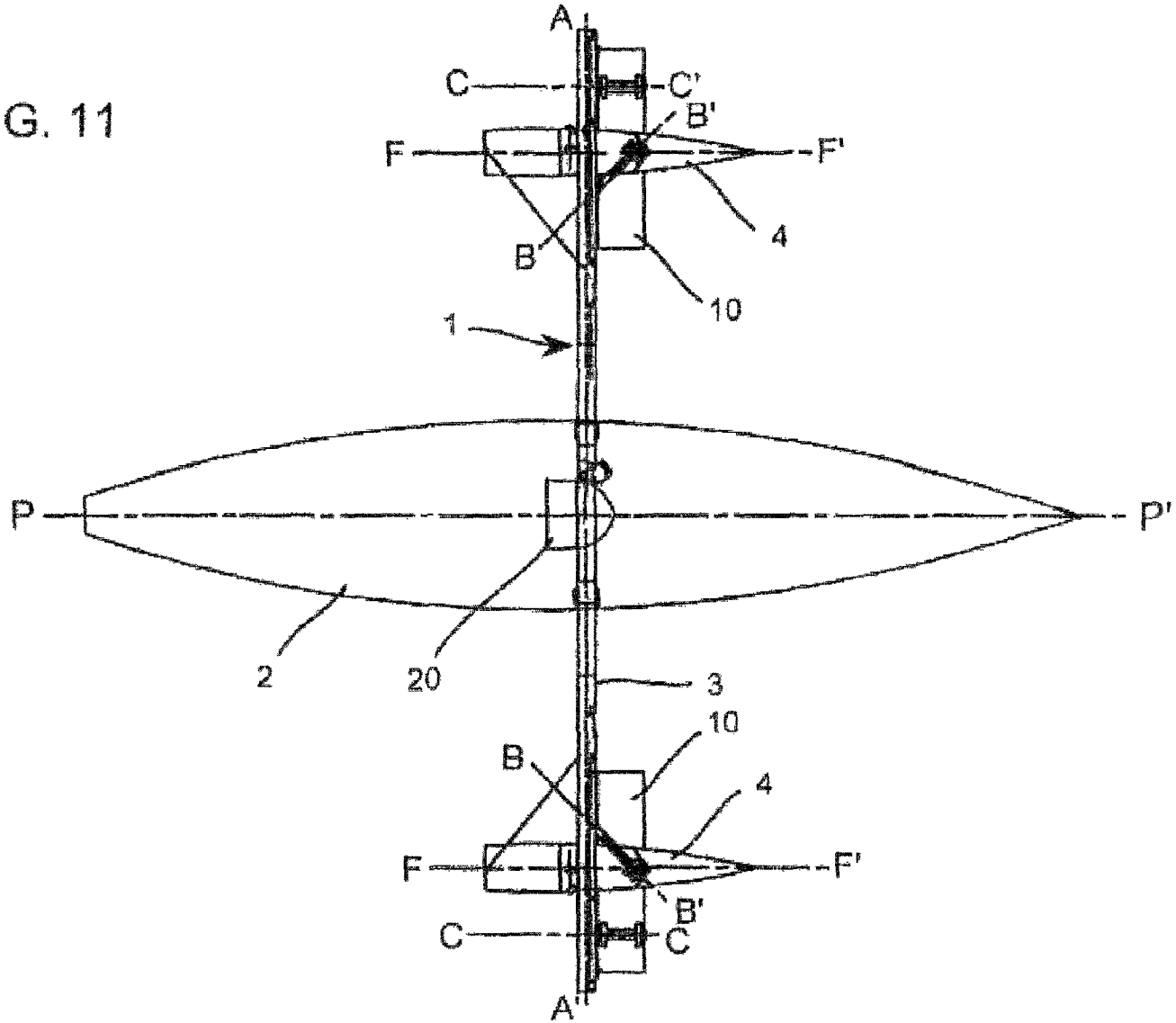
FIG. 11 is a top view of a vessel according to the invention, whereby the device according to the invention is in the deployed position.
Figure 12:
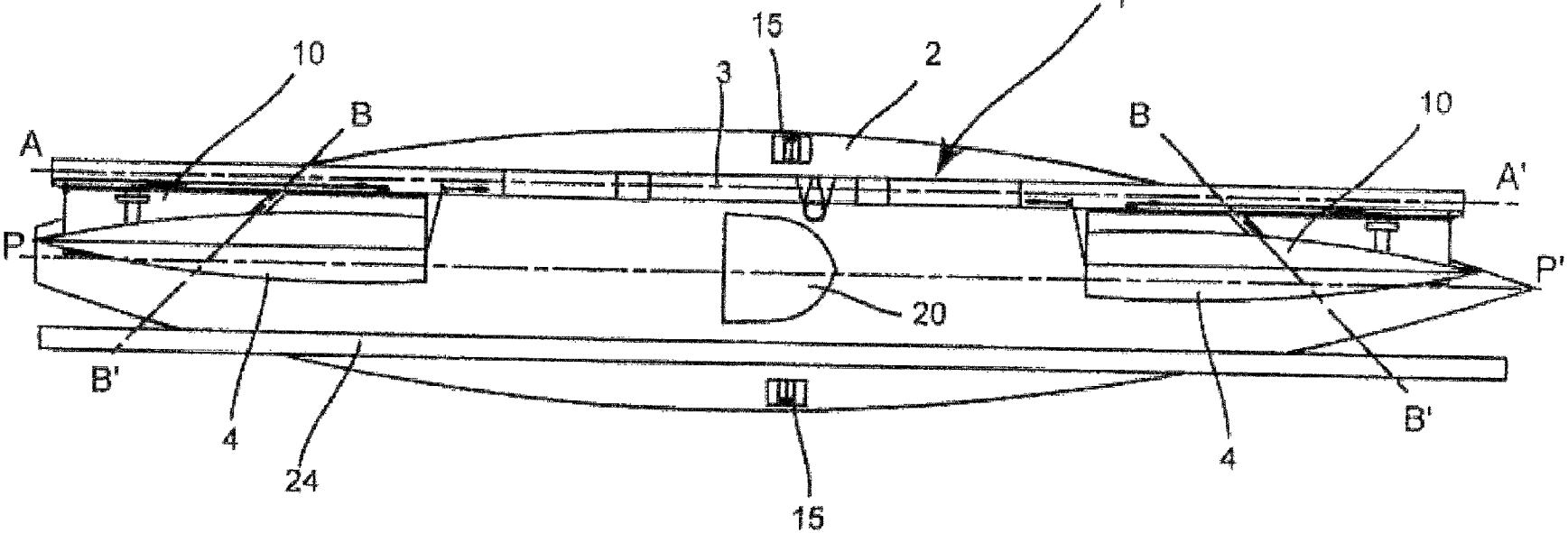
FIG. 12 is a top view of a vessel according to the invention, whereby the device according to the invention is in the folded position.
Figures 13, 14, 15, 16:
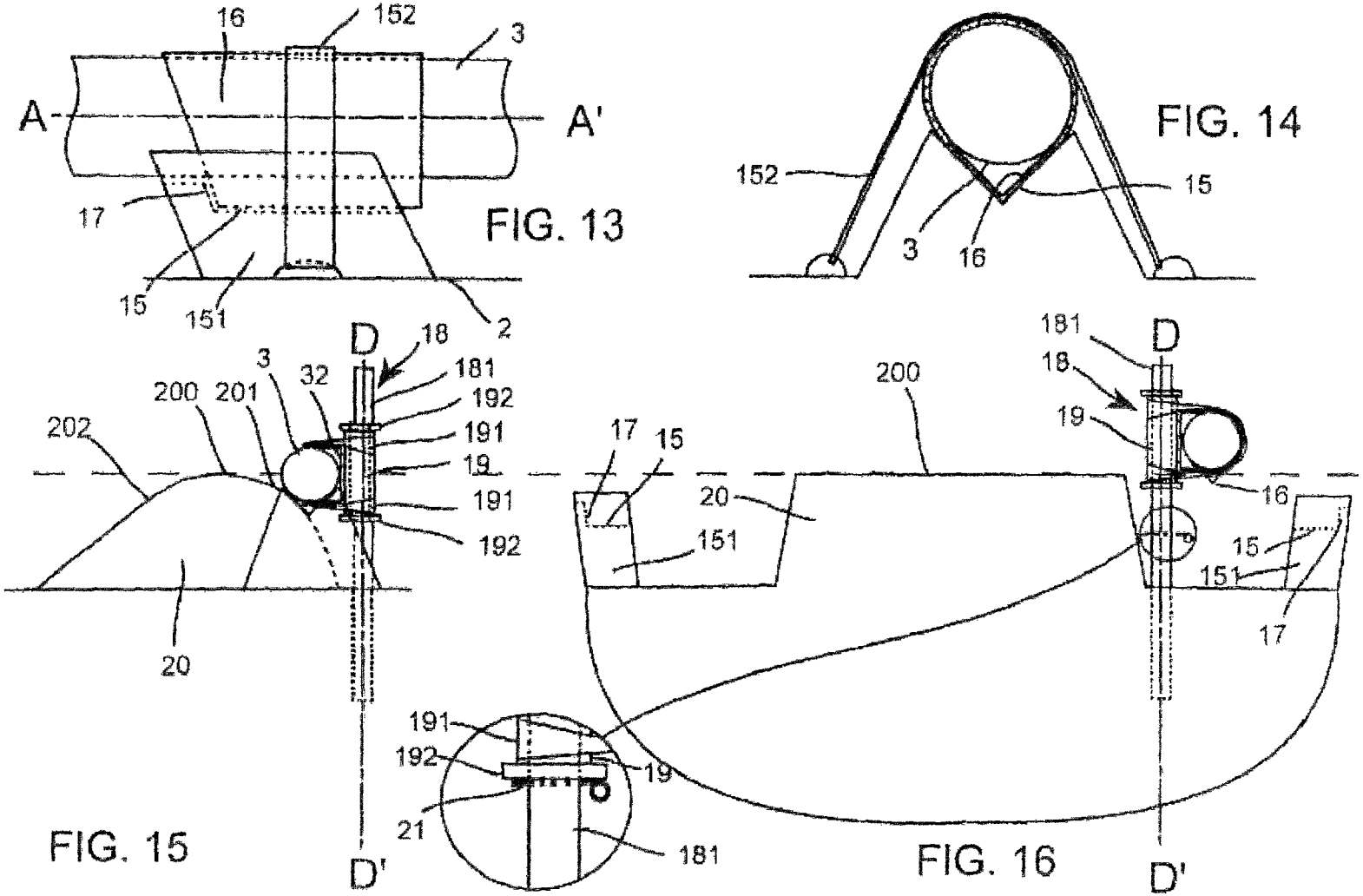
FIGS. 13 and 14 are detail views that show a cradle and its range that is integral with the support structure according to the invention.
FIGS. 15, 16, 17 and 18 are detail views of the system for guiding in rotation and translation of the device according to the invention.
Figure 18:
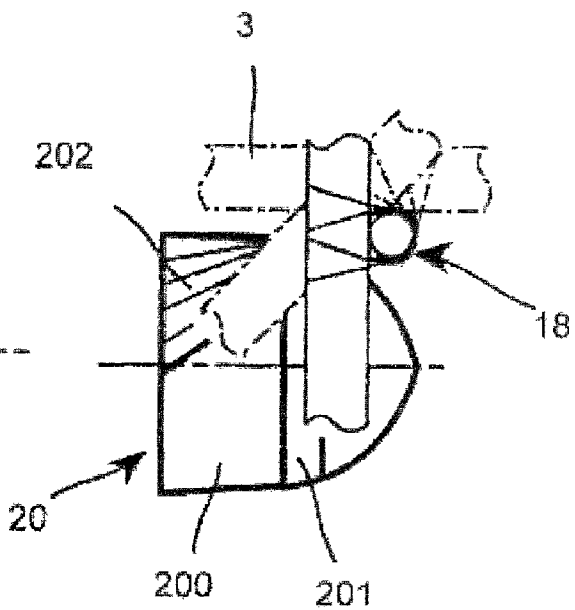
Figure 17:
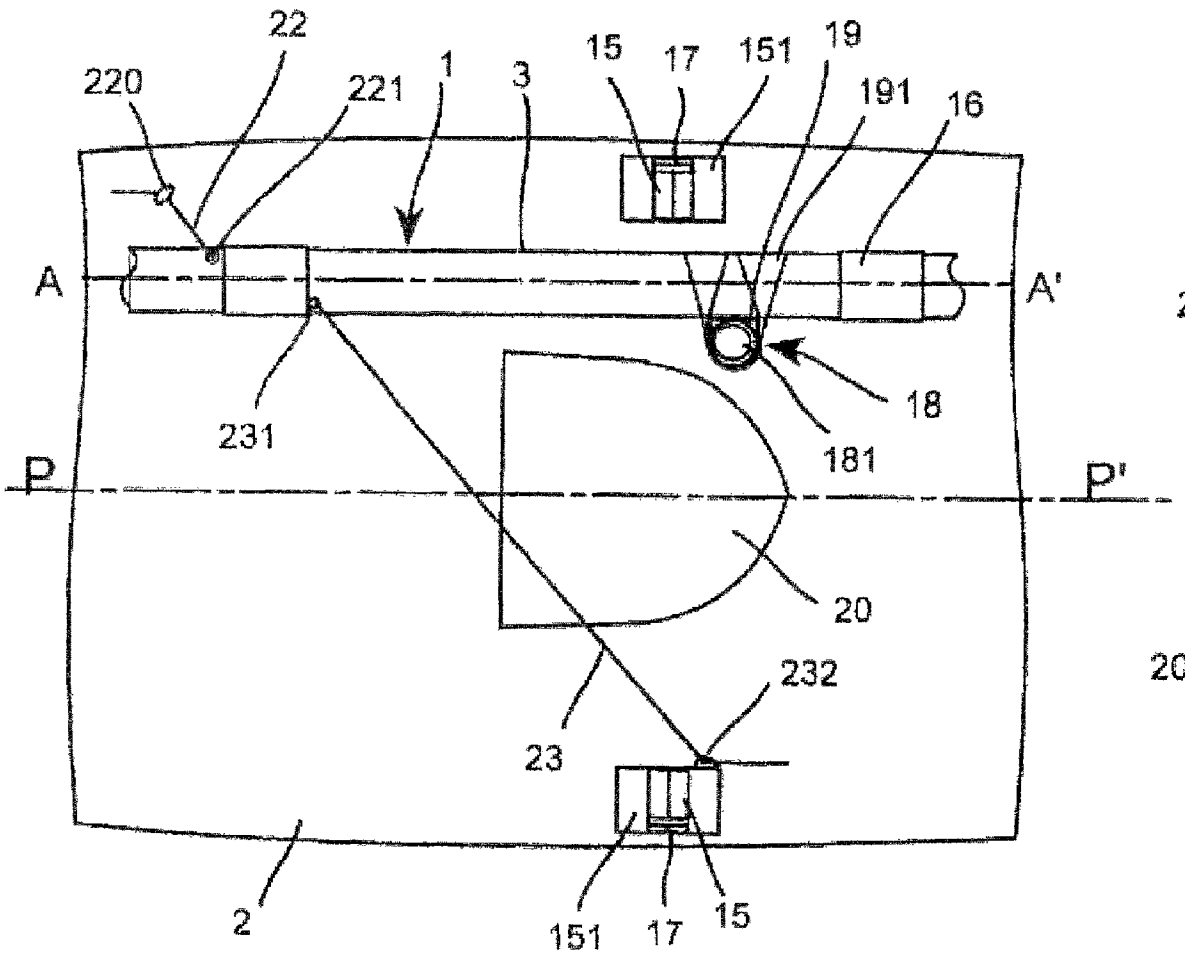
Figures 19, 20:
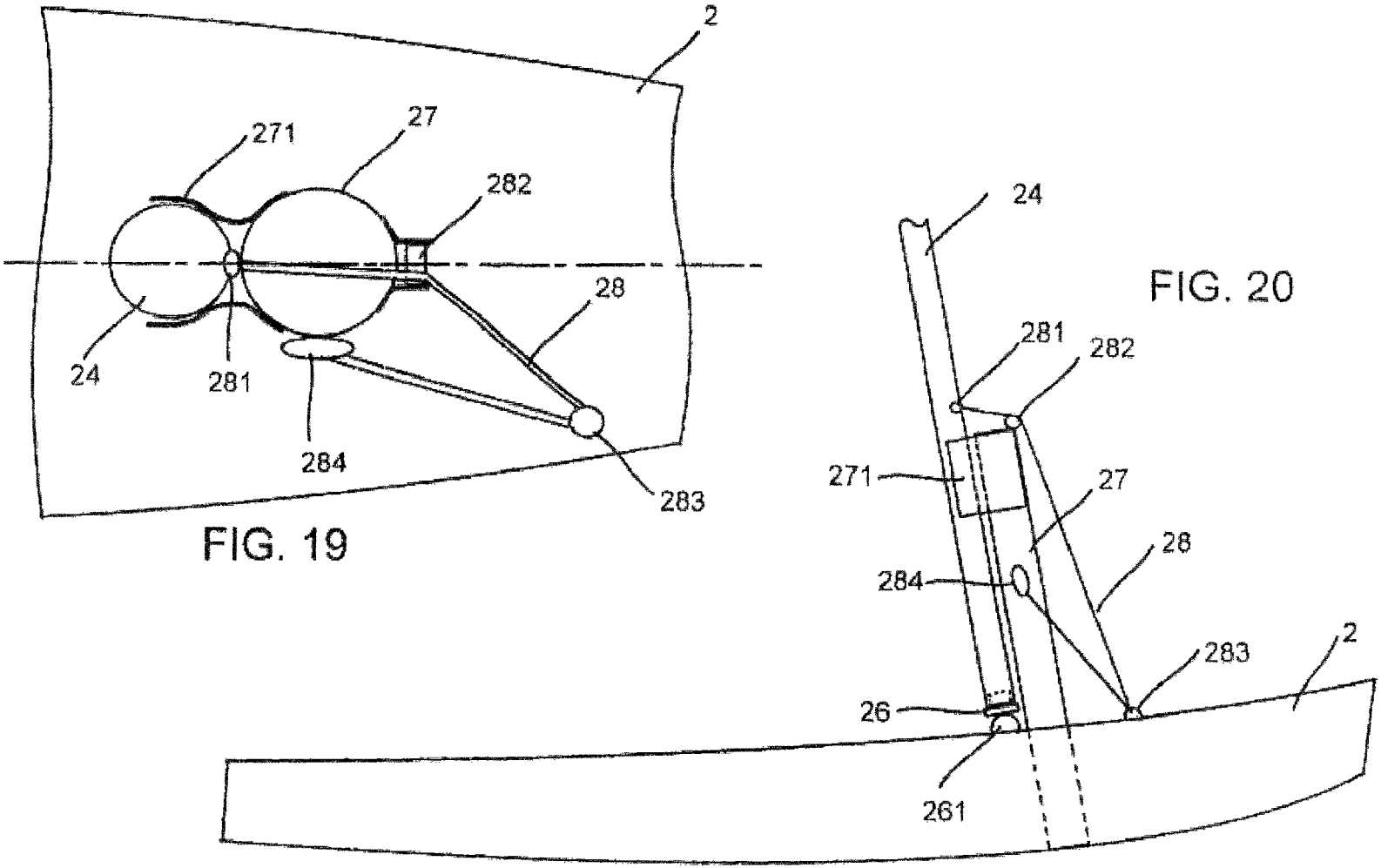
FIGS. 19 and 20 are detail views of the system for rigging of the vessel according to the invention.
Figure 21:
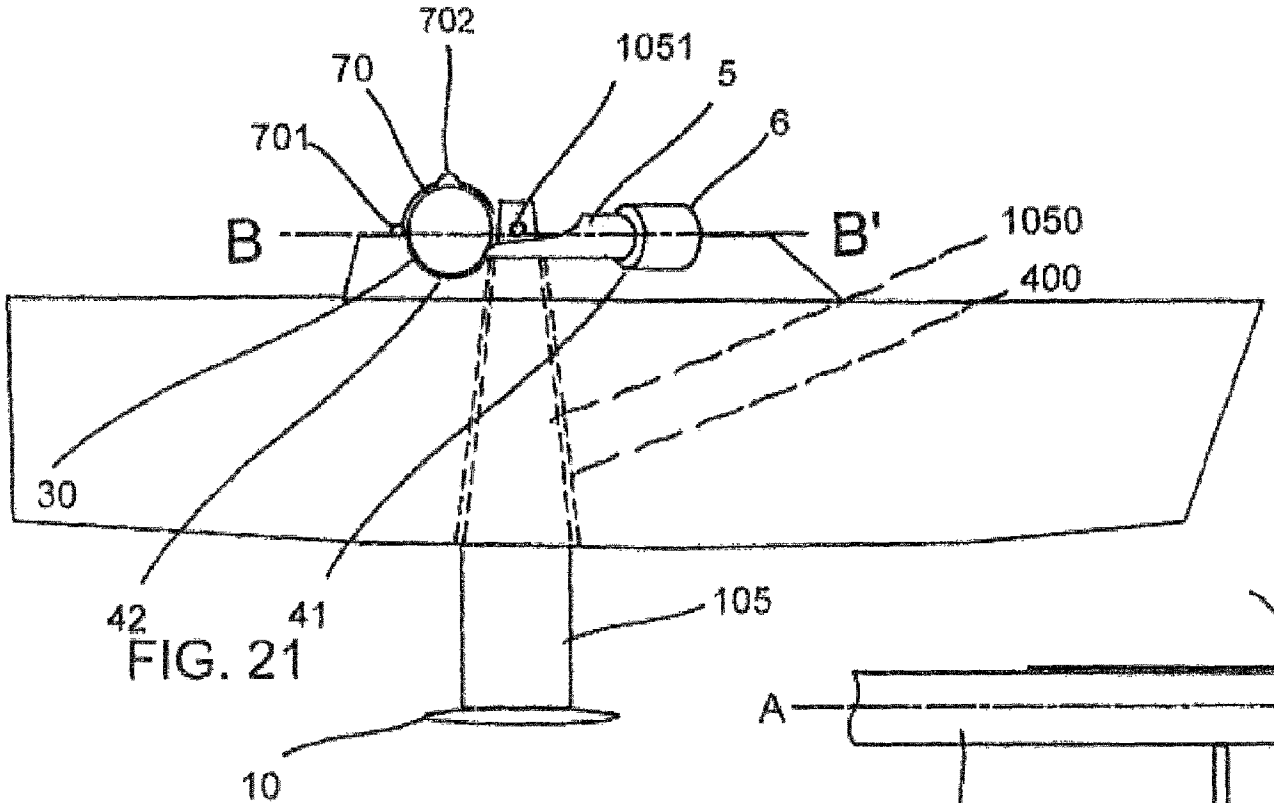
FIG. 21 is a view that shows a foil that is fixed to a float by a strut.
Figure 22:
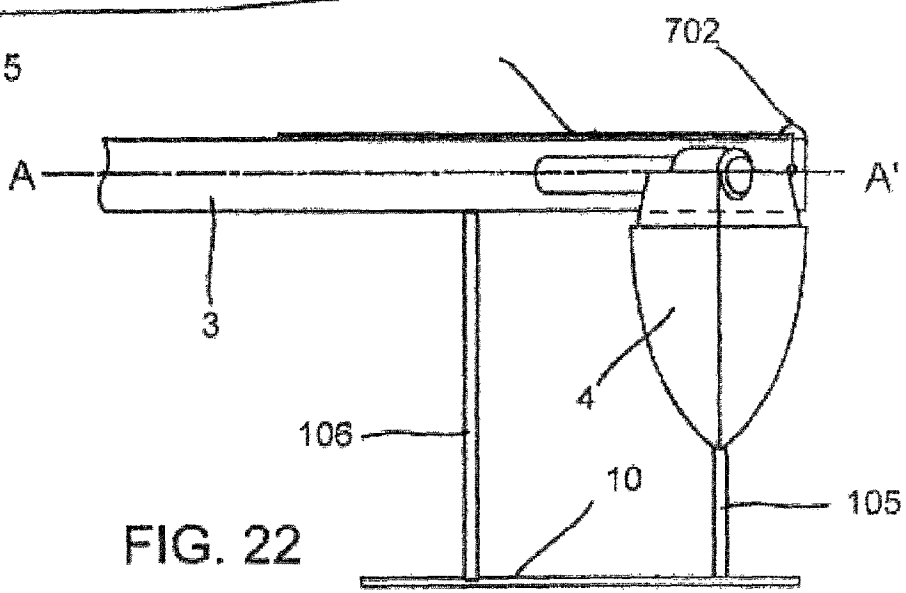
FIG. 22 is a view that shows a foil with an additional strut.

The lateral float 4 can be brought manually into deployed position and into folded and locked position, at least into deployed position by pinning as can be seen in FIG. 8. In this connection, the float 4, at a distance from the axis BB', for example on both sides of the recessed hollow 41 that constitutes the housing with the stop, can accommodate two attached vertical wings 43 that are parallel to the longitudinal axis of the hollow and that have through perforations opposite one another and at a distance from the upper face 40 of the float 4. In the two through perforations of these wings and in a diametric perforation of the stop 30, a removable pin 44 will be engaged.

Preferably, as can be seen in particular in FIG. 1, the device according to the invention is equipped with at least one actuator 7 that is integral with the support structure 3 and integral with the float 4 that can place and keep the float 4 either in the deployed position or in the folded position.

In the preferred embodiment, the actuator 7 comprises two flexible traction links 70, 71 that are attached by one of their ends to the float 4 and are respectively designed for the maneuvering of the float 4 from its folded position to its deployed position and for the maneuvering of the float from its deployed position to its folded position. Furthermore, the actuator 7 comprises in addition two clamps 8, 9, known in the art, that are provided to receive and lock respectively the flexible links 70, 71 for keeping the float 4 in the deployed stable position or in the folded stable position. These flexible links 70, 71 are preferably designed to be manipulated by the user.

The traction link 70 is freely engaged in a first guide 701 in the shape of a ring, secured to the float 4 laterally to the housing 42 of the stop 30 and at a distance from the axis of articulation BB', and it then is freely engaged in a second guide 702 that is also in the shape of a ring that is attached at the end of the stop 30 to the cylindrical face of said stop. The link 70 is then attached by its corresponding end to an anchoring ring 703 that is separated from the axis BB' that is made integral with the float 4, laterally to the housing 42 of the stop 30 opposite the first guide 701. Because of this arrangement, the flexible link is wound part-way onto the stop 30, thus producing a block and tackle. Thus, traction on the flexible link 70 is accompanied by the float 4 pivoting toward its deployed position.

The clamp 8, combined with the traction link 70, is preferably of the type of those comprising the following on a plate: two jaws that are articulated around two parallel axes that each have an eccentric toothed section that is approximately in a circumferential arc that defines a clamping channel of the flexible link in combination with the other toothed section.

The clamp 8 is attached to the float 4, immediately downstream from the first guide ring 701, viewed from the direction of movement of the link 70 when it is pulled for the purpose of bringing the float 4 into deployed position. This arrangement has as its object to reduce the length of the link between the clamp 8 and the anchoring ring 703.

By traction on the link 70, whereby the latter is engaged in the clamp and the link 71 is disengaged from its clamp, the float 4, by pivoting around the journal 5, is brought into deployed position. The disappearance of the traction stress on the link 70 is accompanied by a slight recoiling movement of the latter into the clamping channel of the clamp 8. Under the action of the function forces of the link 70 on the jaws, the latter are stressed by pivoting toward one another and against the link, which ensures the immobilization of the latter in the clamp 8.

To bring the float into folded position, the link 70 is disengaged from its clamp 8 by a whip movement, and traction is exerted on the link 71 until the folded position is attained. This link 71 is attached by one of its ends to a fastener 710, in the shape of a ring, attached to the float 4 and at a distance from the geometric axis BB' and is engaged in a guide 711, in the shape of a ring, attached to the structure 3. It should be noted that the direction of the traction stress applied by the link 71 to the fastener 710 is separated from the axis BB' so as to produce a tipping moment relative to this axis.

An actuator 7 comprising flexible links 70, 71 and clamps 8, 9 was described above, but, as a variant, the actuator can consist of a transmission of movement of a known type that is connected kinematically to the float 4 and supported by the structure 3. As a variant, the actuator 7 will be constituted by a drive element that is integral with the structure 3, on the one hand, and with the float, on the other hand. This drive element can consist of an electric actuator, or a pneumatic actuator or a hydraulic actuator. The drive element may also be of the type of those that have a rotor and a stator. One of these two elements will be coupled to the journal, and the other element will be coupled to the float 4.

According to an advantageous arrangement of the invention, a support element 10 that is known under the English term "foil" is combined with the structure 3. This support element 10 has a lower surface and an upper surface and can generate a lift during the travel of the vessel in the water. This foil is articulated to the structure and can occupy a deployed position or an active position according to which it is immersed at least part-way and is able to generate the lift. According to this position, the upper surfaces and lower surfaces are oblique relative to the horizontal, and the foil 10 has a suitable incidence relative to the direction of travel. Preferably, the foil 10 in the deployed position just abuts against the associated float 4 and is kept in this position, in particular under the action of the lift that is generated. The foil 10 can occupy at least one inactive position according to which it has fully emerged. In the preferred embodiment, the foil 10 can occupy two inactive positions, According to one of these two positions, it is folded against and below and along the structure 3, whereby the float 4 is folded; according to the other position, it projects laterally relative to the structure 3, whereby the float 4 is deployed.

The foil 10 is articulated to the support structure 3 around a geometric axis CC' that is horizontal or approximately horizontal and perpendicular or approximately perpendicular to the axis AA'. In practice, the support structure 3 will be equipped with a joint that consists of a bearing-forming case 101, which is attached to the foil 10, and a journal 102 that is engaged in the case and attached to the arm 3 by any known means, for example by a casing shell 33. This casing shell will consist of half-shells that are attached to one another by bonding along a diametric joint plane to the arm 3 and to the journal 102. These two half-shells will be bonded to the arm 3.

According to the preferred embodiment, the two half-shells, as far as their parts that come around the journal 102 are concerned, are not attached to one another by bonding but at this level form two clamping jaws. In addition, they are combined with a clamping means 331 that is able to apply them firmly against the journal 102 to immobilize the latter both in rotation and in translation. This clamping means can be released to reduce the pressure of the jaws on the journal 102 and to allow the release of the latter. The clamping means 331 advantageously will consist of a clamping collar, detachable, of a known type, engaged around the two jaws.

Preferably, the case 101 that forms a bearing will be engaged in a recessed hollow formed in the upper surface of the foil and kept attached in said hollow by flange elements 1011 that are at a distance from one another, attached to the foil by any known means. The case 101 will be immobilized in translation on the journal 102 by any known means. For example, two annular stops that are formed on the journal 102 respectively on both sides of the case 101 can be provided. Advantageously, these stops 1012 will consist of removable clamping collars of a known type. This arrangement makes possible quick and easy assembly and disassembly of the foil.

Advantageously, an actuator 11 that is integral with the support structure 3 and integral with the foil 10, able to place and keep the foil 10 in the active position or in the inactive position, will be provided.

This actuator 11 comprises two flexible traction links 110, 111 that are engaged in guides 112 that are attached to the support structure 3 and that both are attached to the foil 10 by fasteners 113 that are opposite to one another at a distance from the axis CC' so as to generate moments of opposite forces relative to this axis. The traction on one of the links causes the foil to pivot around the CC' axis in one direction while the traction on the other link causes the foil to pivot around the axis CC' in the opposite direction. In addition, this actuator comprises two clamps 12, 13 that are known in the art and that are mounted in attachment on the support structure 3 with which the flexible links 110, 111 cooperate by locking for keeping the foil 10 in an active stable position or in an inactive stable position.

According to a variant embodiment, the actuator 11 can consist of a transmission of motion that is made integral with the foil and with the structure or a drive element that is integral with the structure 3, on one hand, and the foil 10, on the other hand. This drive element can consist of an electric actuator or a pneumatic or hydraulic actuator. The drive element can also be of the type of those that have a rotor and a stator. Once of these two elements will be coupled to the journal; the other element will be coupled to the foil.

According to another embodiment, the foil is no longer combined with the structure 3 but with the float 4 and is made integral with the latter by a strut 105, and it occupies, when the float is deployed, a position according to which it is immersed at least part-way and is able to generate lift.

The strut 105 is attached to the float 4 by axial interlocking of a male interlocking shape 1050 in a female interlocking shape 400. Preferably, the male interlocking shape 1050 is made on the strut 105 while the female interlocking shape 400 is made in the float 4, but it goes without saying that without leaving the spirit of this invention, the male interlocking shape may be made on the float and the female interlocking shape may be made in the strut.

The straight sections of the male interlocking shape 1050 and the female interlocking shape 400 have equivalent contours so that said shapes are complementary to one another. Preferably, this contour will be non-circular so as to ensure a specific angular locking of the foil relative to the float. This contour can be polygonal.

A straight section is defined as a section through a plane that is perpendicular to the longitudinal axis of each interlocking shape, whereby this axis corresponds to the direction of the movement for introduction of the male interlocking shape 1050 in the female interlocking shape 400. Equivalent contours are defined as contours that are derived from one another by homothetic transformation.

The female interlocking shape, or wells 400, viewed from the direction of introduction of the male interlocking shape 1050, gradually narrows along its length. For this purpose, the female interlocking shape has at least one face, preferably planar, inclined in a convergent manner relative to the opposite face.

The male interlocking shape 1050 is preferably formed in the upper part of the strut 105 and gradually broadens along its length from this upper part. For this purpose, this male interlocking shape 105 has at least one lateral face, preferably planar, inclined in a convergent manner relative to the opposite face. As it is designed, the inclined planar face of the male interlocking shape 1050, when said male interlocking shape is housed in the female interlocking shape 400, comes opposite and against the inclined planar face of said female interlocking shape. It is understood that because of the narrowing of the female interlocking shape 400 and the broadening of the male interlocking shape 1050, said male interlocking shape just abuts said female interlocking shape, which limits its upward motion.

Still according to the preferred embodiment, the female interlocking shape 400 goes through the float 4, and the male interlocking shape 1050, when it is in place in the female interlocking shape 400, creates a projection developing above the float 4 by its upper part.

Advantageously, this projecting part is designed to work with a removable locking means that opposes the downward sliding of the male interlocking shape 1050 into the female interlocking shape 400. According to the preferred embodiment, this locking means consists of a pin 1051 that is provided to be engaged in a through perforation that is made in the projecting part of the male interlocking shape and provided to rest against the float.

In an optional variant embodiment, the foil is held laterally on the float by an additional strut 106 that comes into contact, when the float is in the deployed position, against the structure 3. Advantageously, this strut is attached rigidly to the foil. This arrangement essentially has the effect of opposing an undesired deformation of the foil under the effect of lift forces.

Device 1 as described is preferably equipped with two lateral floats 4, respectively mounted on two ends of the structure 3, whereby a foil 10 can be combined with each float 4.

The device 1 as described is designed to equip a monohull vessel 2 for the purpose of transforming the latter into a multihull vessel. This monohull vessel 2, without this being limiting, can be a kayak or any other vessel.

It should be noted that the device 1 is preferably combined in a removable manner with said vessel 2.

Above or on the bridge, the vessel 2 according to the invention is equipped with at least one cradle 15 that is provided to accommodate, by interlocking of shape and by attachment, in a multihull configuration, at least one bearing 16 of complementary shape located on the support structure 3 of the device, whereby said structure 3, when it is installed and secured in the cradle, is locked in translation and in rotation along the three axes of the space relative to this cradle.

So as to keep the structure 3 from pivoting around the axis AA', the cradle 15 and the bearing 16 will be non-cylindrical in shape. According to the preferred embodiment, the cradle 15 and the bearing 16 will have a polygonal straight section.

Furthermore, to ensure the lateral locking of the structure 3 in the cradle 15, i.e., to kept this structure from moving in translation along the axis AA', said cradle is equipped with at least one stop 17, forming a shoulder, opposite and/or against which is positioned the corresponding lateral face of the bearing 16. Such an arrangement ensures a reference positioning of the device relative to the geometric plane PP' of the vessel and keeps the support structure 3 from any movement along the axis AA' in the cradle or cradles.

Two cradles 15 that are placed symmetrically on both sides of the geometric plane PP' of the vessel 2 are preferably provided. Each of the cradles 15 can be supported above the bridge of the vessel by a support foot 151.

The vessel 2 is equipped with a removable holding element 152 of the support structure 3 of the device 1 in the cradle or cradles 15. According to the preferred embodiment, the holding element 152 consists of a rigid or flexible strap that is held by tension to the structure 3 and is attached to the structure of the cradle 15 and/or to the support foot 151 and/or to the bridge of the vessel 2.

The device 1 in the folded state is designed to be stowed and attached to the bridge of the vessel so that during navigation, the user can transform his monohull vessel into a multihull vessel or vice versa.

To facilitate the change in configuration during navigation, the vessel 2 is equipped with a system 18 for guiding in rotation and translation of the device 1 around and along a vertical geometric axis DD' between a folded position on the bridge of the vessel 2 according to which the geometric axis AA' of the structure 3 of the device 1 is parallel to or combined with the geometric plane PP' and a deployed position according to which the axis AA' of the structure 3 of said device 1 is preferably perpendicular to said above-mentioned plane and according to which the device is installed in the cradle or cradles 15.

Preferably, in the folded position on the vessel 2, the device 1 by the axis AA' occupies a position that is lateral to the geometric plane PP' of said vessel.

The guide system 18 preferably consists of a cylindrical vertical shaft 181 that defines the geometric axis DD' and a vertical cylindrical case 19 that is made integral with the structure 3 of the device 1 and engaged on the vertical shaft 181 with the possibility of rotation on this shaft 181 and translation along the latter. The guiding length of the case 19 on the shaft 181 will be significant enough to rule out any interference phenomenon.

It should be noted that the case 19 can be extracted from the shaft 181, which ensures the ability to remove the device. The shaft 181 is preferably removable. In this respect, this shaft 181 is engaged in a removable manner in a well that is formed in the hull of the vessel.

The structure 3 preferably has a pivoting latitude relative to the vertical case 19 around a horizontal geometric axis that is perpendicular to the axis AA' and perpendicular to the longitudinal axis of said case 19.

Owing to these arrangements, it becomes easy to manipulate and to move the device 1 from the folded position on the bridge of the vessel to its deployed position by translation along the shaft 18 and pivoting around the latter.

In one embodiment, the vertical case 19 will be attached by strapping 191 to the cylindrical arm 3, whereby the latter comprises a vertical flat surface 32 resting against the case 19.

This arrangement allows the pivoting of the arm 3 relative to a horizontal axis that is perpendicular to the longitudinal axis of the vertical case 19 but keeps the arm from pivoting along the axis AA'. Furthermore, the strapping limits the amplitude of the possible pivoting movement of the arm 3 relative to the case 19.

Preferably, the case 19 has two annular barrier stops 192 that are separated from one another and that ensure the securing of the strap in the interval that they define.

Also to facilitate the change in configuration, the vessel 2 has a projection 20 on which a support surface 200, on which the structure 3 can temporarily be supported during the change in configuration of the vessel, is formed at a height that is slightly above that of the cradle or cradles 15. A ramp surface 201 that is formed in the projection, on which the structure 3 is caused to slide during its movement between said temporary support surface 200 and the cradle or cradles, is combined with this support surface 200.

A second ramp surface 202 that is formed in the projection 20 and that extends from the bridge of the vessel up to the temporary support surface 200 can be combined with the support surface 200. This ramp surface 202, viewed from the path of the arm over the projection, is opposite to the preceding one. The support surface 200 forms the top zone of the projection.

This second ramp surface 202 is provided to accommodate by sliding the structure 3 of the device 1 and to guide the movement of the latter between the stowed position on the bridge and the support position on the temporary support surface 200.

Owing to these ramp surfaces 201, 202, a rotational movement imprinted on the structure 3 around the shaft 18 will produce a translational movement along the shaft 18.

To facilitate the manual change in configuration, the vertical shaft 181 is able to accommodate in a removable manner a support element 21 of the device 1, whereby on the vertical shaft, this support element occupies a lower position relative to that occupied by the cradle or the cradles and a higher position relative to the bridge. This support element 21 constitutes a removable obstacle with the translational movement of the device 1 downward and along the case during the manual folding operation of said device on the bridge.

In the preferred embodiment, this temporary support element consists of a pin 21, and the shaft 181 will be equipped with a diametric through perforation for accommodating this pin. The device 1 rests on the support element 21 via the case 19.

To facilitate the maneuvering of the device and more specifically to facilitate the release of the structure 3 from the cradle or cradles, a traction element 22 is provided in the form of a link, attached to the support structure 3, at a distance from the axis 181, by a fastener 221. In addition, this link 22 can be engaged in a ring 220 that is attached to the vessel 2 and that occupies, on the vessel, a position that is close to the one that is occupied by the fastener 221 of this link 22 to the structure 3, when the device 1 is folded on the bridge.

It may also be possible to provide a second traction link 23 to deploy the device and to bring it into place by its structure 3 into the cradle or cradles 15. This second traction link 23 will be secured by a fastener 231 to the structure 3 of the device 1 at a distance from the shaft 181 and will be engaged in a guide ling 232 that is secured, for example, to the support foot 151 of the cradle 15 that is the farthest removed from this shaft 181.

According to an advantageous arrangement of the invention, the two links 22, 23 are actuated manually or by a winch-drive system, for example, or another traction system.

The system 18, as it is understood, participates in keeping the device 1 on the vessel 2. Keeping the device on the vessel in the folded state can be accomplished by stowing it by any known means.

The vessel 2 can be equipped with removable rigging that can preferably be folded on the bridge.

Preferably so as to balance the loads, the rigging in the folded state occupies a position that is lateral to the vertical geometric plane PP' that is opposite to the position occupied by the device 1 in the folded state on the bridge of the vessel.

This rigging comprises a preferably tubular mast 24 and a sail, not shown. The vessel will be equipped with a mast foot 26 that is provided to work with the base of the mast 24 by interlocking of shape, whereby this mast foot 26 is made integral with an element of the vessel by a ball-joint-type connection 261. Advantageously, this ball-joint connection can consist of an elastomer dolly axle of the type of those used to make the masts of sailboards integral with said sailboards.

To lock the mast in vertical position, the vessel will be equipped with a mast support 27 that projects upward, comprising at a distance from its lower end a fork shape 271 in which the mast 24 will be engaged. This mast 24 will be locked against the support of mast 27 by a suitable halyard 28. The support of mast 27 will preferably be removable. In operating position, the support of mast 27 will be engaged by its lower part in a well that is formed in the hull of the vessel.

Preferably, the halyard 28 will be attached by one of its ends to an anchoring ring 281 that is attached to the mast above, and, with the spacing of the upper end of the mast support, will be engaged in a return element 282 that is attached at the upper end of the mast support 24, then in a guide element 283 in the shape of a ring that is attached to the bridge of the vessel 2, and then it will be engaged in a locking element 284 that can be a stopper or a clamp, able to be attached to the mast support.

This arrangement, owing to the tension of the halyard 28, ensures the immobilization of the mast 24 in the shape of a fork 271 that the mast support 27 has, ensures the translational immobilization of the mast 24 along its longitudinal axis but also ensures the immobilization of the mast support 27 in its well. For a light kayak-type vessel, the device 1 will be made of light materials in order to have a weight that is compatible with manual manipulation by the user during navigation.

The invention claimed is:

1. Device (1) for transforming a monohull vessel (2) into a multihull vessel, comprising:

a support structure (3) that is provided to be attached in a removable manner to the vessel (2), whereby the support structure (3) has a geometric axis AA' which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, wherein the axis (AA') is perpendicular to the geometric plane (PP') of the vessel (2) and, when projected into the horizontal plane, the geometric axis (BB') and the geometric axis (AA') form an angle that is equal or approximately equal to 45 degrees, and the geometric axis (BB') and the geometric axis (FF') in the deployed position of the float (4) form an angle that is equal or approximately equal to 45 degrees.

2. Device (1) according to claim 1 wherein the support structure (3) is a longitudinal arm, whereby the longitudinal geometric axis of said arm (3) and the geometric axis (AA') are combined.

3. Device (1) according to claim 1 further equipped with two lateral floats (4), whereby a foil (10) can be combined with each float (4).

4. Vessel (2), further equipped with at least one device (1) according to claim 1.

5. Vessel according to claim 4 wherein above or on a bridge, the vessel is further equipped with at least one cradle (15) that is provided to accommodate, by interlocking of shape and by attachment, in a multihull configuration, at least one bearing (16) of complementary shape located on the support structure (3) of the device, whereby said structure (3), when installed in the cradle and secured in the cradle, is locked in translation and in rotation along the three axes of the space relative to this cradle (15).

6. Vessel (2) according to claim 5 wherein the shape of the cradle (15) and the shape of the bearing (16) are non-cylindrical and wherein said cradle (15) is equipped with at least one stop (17) that forms a shoulder, opposite and/or against which the corresponding lateral face of the bearing (16) is positioned.

7. Vessel (2) according to claim 4 further equipped with a system (18) for guiding the device (1) in rotation and translation around and along a vertical geometric axis DD' between a folded position on a bridge of said vessel (2) according to which the geometric axis of the structure (3) of the device (1) is parallel to or combined with the geometric plane PP' of said vessel (2) and a deployed position according to which the axis (AA') of the structure (3) of said device (1) is perpendicular to said geometric plane PP' and according to which the device (1) is in place in the cradle or cradles (15).

8. Vessel (2) according to claim 7 wherein the guide system (18) comprises a cylindrical vertical shaft (181) that defines the geometric axis (DD') and a vertical cylindrical case (19) that is made integral with the structure (3) of the device (1) and engaged on the vertical shaft (181) with the possibility of rotation on this shaft (19) and translational movement along the latter.

9. Vessel (2) according to claim 8 wherein the structure (3) has a pivoting latitude relative to the vertical case (19) around a horizontal geometric axis that is perpendicular to the axis AA' and perpendicular to the longitudinal axis of the case (19).

10. Vessel (2) according to claim 4 further comprising a projection (20) on which a support surface (200), on which the structure (3) can temporarily be supported during the change in configuration, is formed at a height that is slightly above that of the cradle or cradles (15), and wherein said support surface is combined with a first ramp surface (201) on which the structure (3) is caused to slide during its movement between said temporary support surface (200) and the cradle or cradles (15).

11. Vessel (2) according to claim 10 wherein the support surface (200) is combined with a second ramp surface (202), formed on the projection (20), on which the structure (3) of the device (1) is caused to slide between the stowed position on a bridge of the vessel (2) and the support position on the support surface (200).

12. Vessel (2) according to claim 4 further equipped with removable rigging that comprises a mast (24) and a sail, wherein said vessel (2) is equipped with a mast foot (26) that is provided to work with the base of the mast (24) by interlocking of shape and that is made integral with an element of the vessel (2) by a ball-joint-type connection (261), and wherein said vessel (2) is equipped with a mast support (27) that projects upward, provided for accommodating and locking the mast (24), whereby said mast support (27), at a distance from its lower end, is equipped with a fork shape (271) in which the tubular mast (24) is housed and wherein the mast (24) is locked against the mast support (27) by a halyard (28).

13. Device (1) for transforming a monohull vessel (2) into a multihull vessel, comprising:

a support structure (3) that is provided to be attached in a removable manner to the vessel (2), whereby the support structure (3) has a geometric axis AA' which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, wherein the support structure (3) is equipped with at least one cylindrical journal (5) that is engaged in a guide bearing (6) that is formed on the float (4), whereby the median longitudinal axis of the cylindrical journal (5), the longitudinal median axis of the guide bearing (6) and the geometric axis (BB') are combined.

14. Device (1) for transforming a monohull vessel (2) into a multihull vessel, comprising:

a support structure (3) that is provided to be attached in a removable manner to the vessel (2), whereby the support structure (3) has a geometric axis AA'which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, characterized by an actuator (7) that is integral with the support structure (3) and integral with the float (4) that can place and keep the float (4) either in the deployed position or in the folded position.

15. Device (1) according to claim 14 wherein the actuator (7) comprises two flexible traction links (70, 71) that are engaged in guides that are attached to the support structure (3) and to the float (4), whereby said actuator (7) also comprises two clamps (8, 9) that are attached to the support structure (3), provided to respectively receive and lock the flexible links (70, 71) to keep the float (4) in the folded stable position or in the deployed stable position.

16. Device (1) for transforming a monohull vessel (2) into a multihull vessel, comprising:

a support structure (3) that is provided to be attached in a removable manner to the vessel (2), whereby the support structure (3) has a geometric axis AA'which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, characterized by an angular stop (30) against which the float (4) abuts in the deployed position.

17. Device according to claim 16 wherein the stop (30) is integral with the structure (3) or is formed in the latter and wherein the upper face (40) of the float (4) is equipped with a housing (42) that is designed to abut the stop (30) in the deployed position of the float (4).

18. Device (1) for transforming a monohull vessel (2) into a multihull vessel, comprising:

a support structure (3) that is provided to be attached in a removable manner to the vessel (2), whereby the support structure (3) has a geometric axis AA'which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, characterized by at least one foil (1) that is articulated to the support structure (3) that can occupy:

an active position, according to which the foil is immersed at least part-way and is able to generate a lift and according to which the foil just abuts against the float (4), and at least one inactive position corresponding to when the foil has fully emerged.

19. Device (1) according to claim 18 wherein the foil (10) is articulated to the support structure (3) around a geometric axis (CC') that is perpendicular or approximately perpendicular to the axis (AA').

20. Device (1) according to claim 18 characterized by an actuator (11) that is integral with the support structure (3) and integral with the foil (10), able to place and keep the foil (10) in the active position or in the inactive position.

21. Device (1) according to claim 20 wherein the actuator (11) comprises two flexible traction links (110, 111) that are engaged in guides (112) that are attached to the support structure (3) by fasteners (113) that are opposite and both attached to the foil (10) at a distance from the axis (CC'), so as to generate moments of opposite forces relative to this axis, whereby said actuator (11) also comprises two clamps (12, 13) that are attached to the support structure (3) with which the flexible links (110, 111) work by locking to keep the foil (10) in the active stable position or in the inactive stable position.

22. Device (1) for transforming a monohull vessel (2) into a multihull vessel, comprising:

a support structure (3) that is provided to be attached in a removable manner to the vessel (2), whereby the support structure (3) has a geometric axis AA' which, when the structure (3) is in a multihull configuration position, is horizontal or approximately horizontal, and when projected in the horizontal plane, has an angle of more than 30 degrees with a horizontal geometric axis that is secant to the support structure and that is contained in the longitudinal vertical geometric plane (PP') that contains a keel line of the vessel (2), and at least one lateral float (4) that has a longitudinal axis (FF') that is contained in the geometric plane that contains the keel line, whereby said float (4) is made integral with this support structure in an articulated manner around at least one geometric axis (BB') that is secant and oblique to the axis (AA'), and whereby, by the longitudinal geometric axis (FF'), said float (4) can occupy a first deployed stable position along which the float is parallel to the geometric plane (PP') of the vessel (2), and, by the lowest point of the keel line, the float is placed under the geometric axis (BB'), and a second folded stable position that is separated from the preceding position at an angle, characterized by a foil (10) that is combined with the float (4) and made integral with the float by a strut (105), whereby said foil (10) occupies, when the float is deployed, a position according to which the float is immersed at least part-way and is able to generate lift.

23. Device (1) according to claim 22 wherein the strut (105) is attached to the float (4) by axial interlocking of a male interlocking shape (1050), made on the upper part of the strut (105), in a female interlocking shape (400), made in the float (4).

24. Device (1) according to claim 23 wherein the female interlocking shape (1050), viewed in the direction of introduction of the male interlocking shape (1050), gradually narrows along its length and wherein the male interlocking shape (1050) gradually broadens from its upper part to the lower part of the strut (105).

25. Device (1) according to claim 23, wherein the female interlocking shape (400) passes through the float (4) and wherein the male interlocking shape (1050), when the float is installed in the female interlocking shape (400), projects, by its upper part, above the float (4) and wherein this projecting part is designed to work with a removable locking means (1051) that opposes the sliding downward of the male interlocking shape (1050) in the female interlocking shape (400).

26. Device (1) according to claim 22 wherein the straight sections of male interlocking shapes (1050) and female interlocking shapes (400) have equivalent contours so that said shapes are complementary to one another, whereby said contour is non-circular.

* * * * *